US007543539B2

(12) United States Patent
Miller

(10) Patent No.: US 7,543,539 B2
(45) Date of Patent: Jun. 9, 2009

(54) PALLET HAVING DIVIDED AREAS SUPPORTING SEPARATELY REMOVABLE PORTIONS OF A PALLET LOAD

(75) Inventor: Daniel R. Miller, Cincinnati, OH (US)

(73) Assignee: Buckhorn, Inc., Milford, OH (US)

( * ) Notice: Subject to any disclaimer, the term of this patent is extended or adjusted under 35 U.S.C. 154(b) by 0 days.

(21) Appl. No.: 11/395,330

(22) Filed: Apr. 3, 2006

(65) Prior Publication Data

US 2006/0219137 A1 Oct. 5, 2006

(51) Int. Cl.
*B65D 19/00* (2006.01)

(52) U.S. Cl. ..... 108/51.11; 108/52.1

(58) Field of Classification Search ..... 108/51.11, 108/52.1, 55.1, 55.3, 55.5, 57.25, 57.3, 57.28, 108/51.3; 248/346.02
See application file for complete search history.

(56) References Cited

U.S. PATENT DOCUMENTS

| | | | | | |
|---|---|---|---|---|---|
| 2,463,588 | A * | 3/1949 | Arthur | 108/52.1 |
| 2,662,710 | A * | 12/1953 | Lapham | 108/52.1 |
| 2,700,521 | A * | 1/1955 | Lapham | 108/52.1 |
| 3,255,720 | A * | 6/1966 | Pasquier | 108/51.11 |
| 3,294,041 | A * | 12/1966 | Lesshiem | 108/57.33 |
| 4,059,057 | A * | 11/1977 | Carnwath | 108/57.17 |
| 4,765,252 | A * | 8/1988 | Shuert | 108/55.1 |
| 4,808,060 | A * | 2/1989 | Wasylyshyn | 108/52.1 |
| 4,972,782 | A * | 11/1990 | Shepherd et al. | 108/52.1 |
| 5,249,699 | A * | 10/1993 | Williams | 108/55.1 |
| 5,327,839 | A * | 7/1994 | Herring et al. | 108/51.3 |
| 5,507,237 | A * | 4/1996 | Barrow et al. | 108/55.1 |
| 5,533,456 | A * | 7/1996 | Regina | 108/57.29 |
| 5,833,207 | A * | 11/1998 | Hagenhoff et al. | 108/51.11 |
| 6,216,608 | B1 * | 4/2001 | Woods et al. | 108/57.25 |
| 6,490,982 | B1 * | 12/2002 | Trickett | 108/51.11 |
| 6,508,182 | B1 * | 1/2003 | Smorgan et al. | 108/57.28 |
| 6,524,426 | B1 * | 2/2003 | St. John et al. | 108/51.11 |
| D476,789 | S * | 7/2003 | Apps et al. | D34/38 |
| 6,874,428 | B2 * | 4/2005 | Apps | 108/57.25 |
| 2006/0278137 | A1 * | 12/2006 | Shimada | 108/51.11 |

FOREIGN PATENT DOCUMENTS

| | | | |
|---|---|---|---|
| JP | 06072443 | A * | 3/1994 |
| JP | 06156492 | A * | 6/1994 |
| WO | WO 9418081 | A1 * | 8/1994 |

* cited by examiner

*Primary Examiner*—José V Chen
(74) *Attorney, Agent, or Firm*—Mattingly & Malur, P.C.

(57) ABSTRACT

A pallet for use with forklifts and pallet jacks has entry ways for the tines or blades of the forklift or pallet jack that are aligned with open areas in the top deck of the pallet. This enables removal of a part of the load on the pallet aligned with the open area in the top deck by inserting a tine(s) or blade(s) into one or a pair of the entry ways, raising the tine(s) or blade(s) to pass through the open area in the top deck and engage the part of the load of the pallet. Then, the part of the load can be separately removed from the pallet without disturbing the remainder of the load supported on the pallet. The top deck of the pallet is divided into quadrants, and a load can be assembled on the pallet that is different in one or more of the quadrants.

2 Claims, 6 Drawing Sheets

PALLET HAVING DIVIDED AREAS SUPPORTING SEPARATELY REMOVABLE PORTIONS OF A PALLET LOAD

BACKGROUND OF THE INVENTION

1. Field of the Invention

The present invention relates to a pallet made of synthetic resin or wood for use with a fork lift.

2. Description of Related Art

Pallets are made from wood or lumber and are also manufactured by injection or structural foam molding. Pallets are used for shipping and storage of loads throughout many industries such as the automotive, dairy, textile and general manufacturing industries. In many industries, such as retail distribution for example, pallets are used for shipping goods from a manufacturer to a distribution site and from the distribution site to an end user, such as a retail outlet.

Known pallets have four-way entry features allowing efficient handling from any orientation of the pallet by fork lifts and pallet jacks. Pallet loads are typically formed at a manufacturing site and the number and order of products or goods supported by each pallet is decided by the manufacturer in accordance with the manufacturer's operation.

However, pallets are also useful for distribution of products from a distribution center to an end user, such as retail outlet. It is inconvenient, however, to assemble a load at a distribution center on a pallet that will be shipped to an end user when the pallet load is to be made up of different goods from the same or different manufacturers.

BRIEF SUMMARY OF THE INVENTION

It is object of the present invention to provide a pallet of wood, plastic or structural foam that is ideal for use in shipping, storage and distribution in a variety of industries in which mixed load pallets are provided to an end user. The pallet of the present invention is suitable for use with forklifts and pallet jacks in which the entry features are different along one side of the pallet as compared with the other side or end of the pallet. In particular, along one side of the pallet, entry features are suitable to permit the blades of a forklift to pass underneath the top deck of the pallet and lift the entire load of the pallet in the conventional manner. On the other hand, entry features at the other side or end of the pallet enable a blade of a hand truck, forklift or pallet jack to remove a partial load off the pallet via an opening or open area in the top deck.

These and other objects of the invention will become clear from the brief description of the drawings and the detailed description of the preferred embodiment.

BRIEF DESCRIPTION OF THE SEVERAL VIEWS OF THE DRAWINGS

The objects, features and advantages of the present invention are more fully understood from the following detailed description of the invention set forth with respect to the brief description of the drawings in which like reference characters designate like or corresponding parts throughout the several figures.

Pallet 10 of the invention has features that are known in the prior art. In this regard, except for the top deck of the pallet, the pallet is of the type manufactured by Buckhorn, Inc. and sold under the trade name Universal Pallet, which is commercially available from Buckhorn, Inc.

The difference between the present invention and that of the known Universal Pallet is in the layout of the top deck of the pallet. In particular, the top deck 20 of pallet 10 has open areas 30 in top deck 20, as will be explained in greater detail hereinafter.

Figure 1:
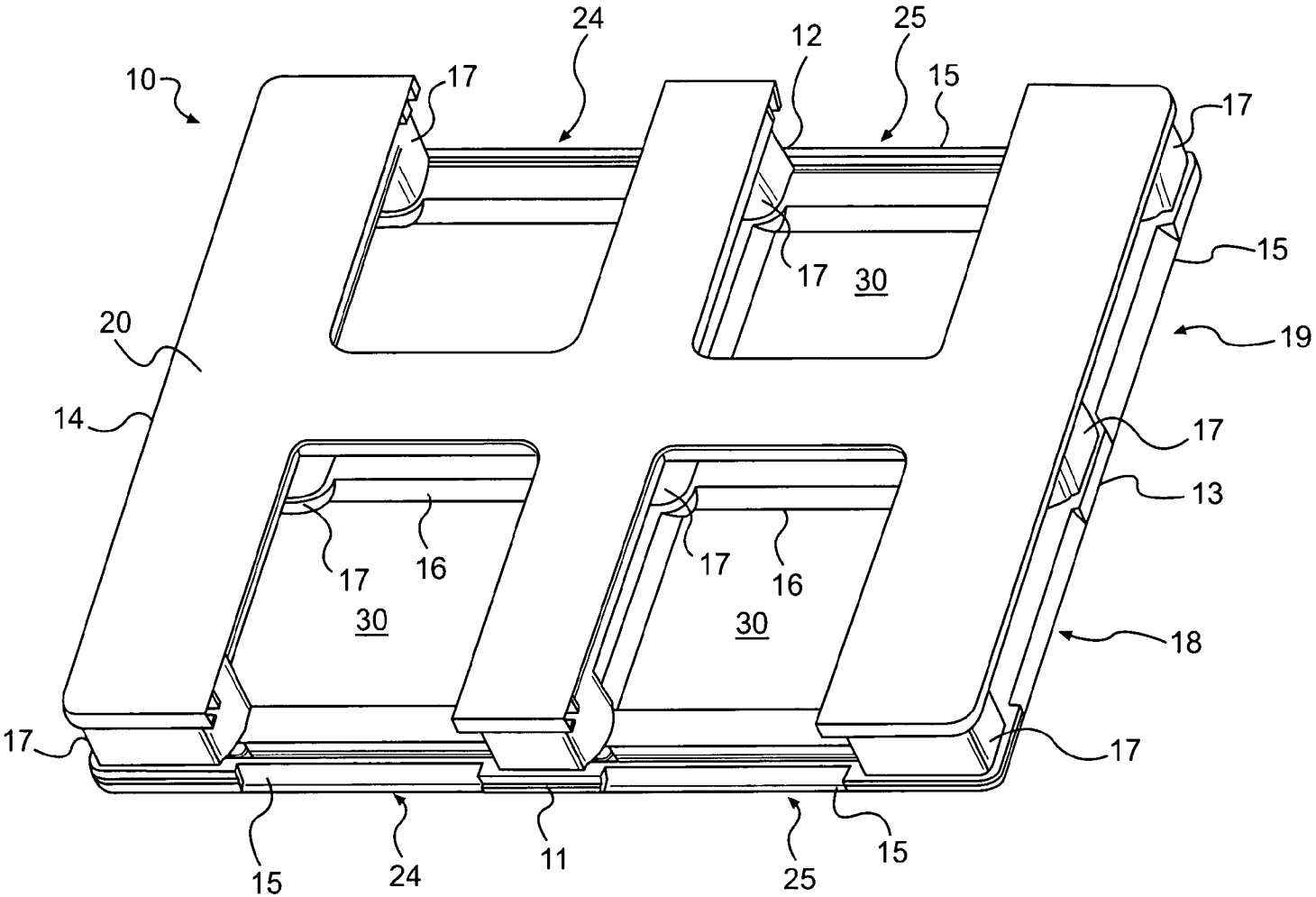
FIG. 1 is a perspective view of one embodiment of a pallet constructed according to the present invention.
Figure 2:
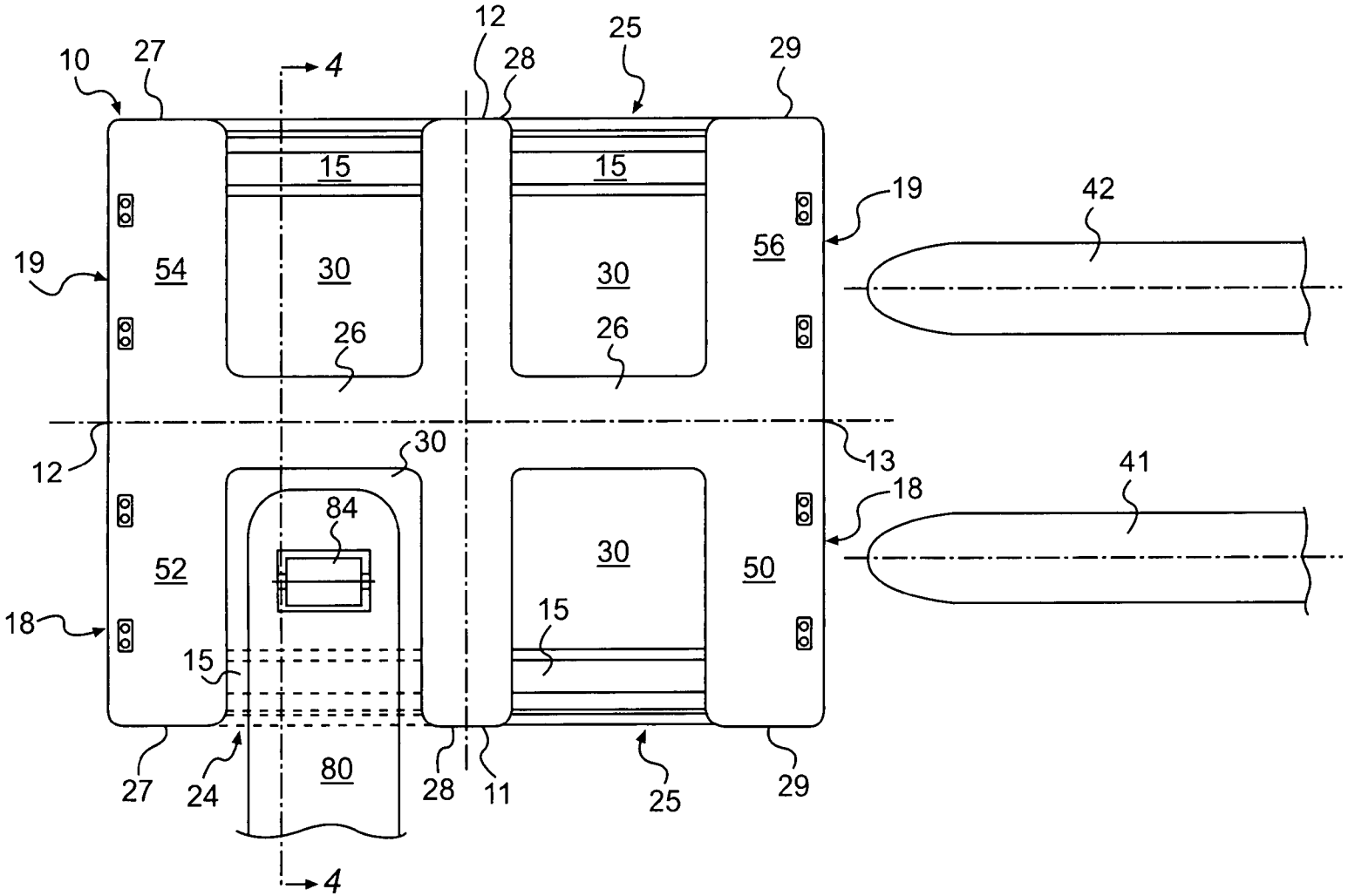
FIG. 2 is a top plan view of the pallet shown in FIG. 1.

Referring to FIGS. 1 and 2, the pallet 10 of the present invention has sides 11, 12, and ends 13, 14. Bottom rails 15 of the pallet are essentially similar in construction along both the sides and ends of the pallet. Additionally, interior rail 16 extend between the sides and ends, respectively, as shown.

Although the pallet 10 is shown to be of the type manufactured by injection molding or structural foam molding, the pallet can be constructed in the same design from wood in which the essential rail features 15, 16 extend along the bottom of the pallet and the top deck 20 of the pallet is supported by posts 17. Between the posts 17 are formed conventional entry ways 18, 19 for receiving the blades of a forklift 41, 42 respectively that would be able to lift the entire pallet in a conventional manner. Also between posts 17 along the sides 11 and 12 of the pallet are entry ways for the blades of a forklift, however the blades 41, 42 of a forklift entering through the entry way 24, 25 only engages the mid-portion span 26 of the top deck 20 of pallet when supporting the load, which may be sufficient in certain instances, however, it may be undesirable depending upon the load placed on the pallet.

Figure 5:
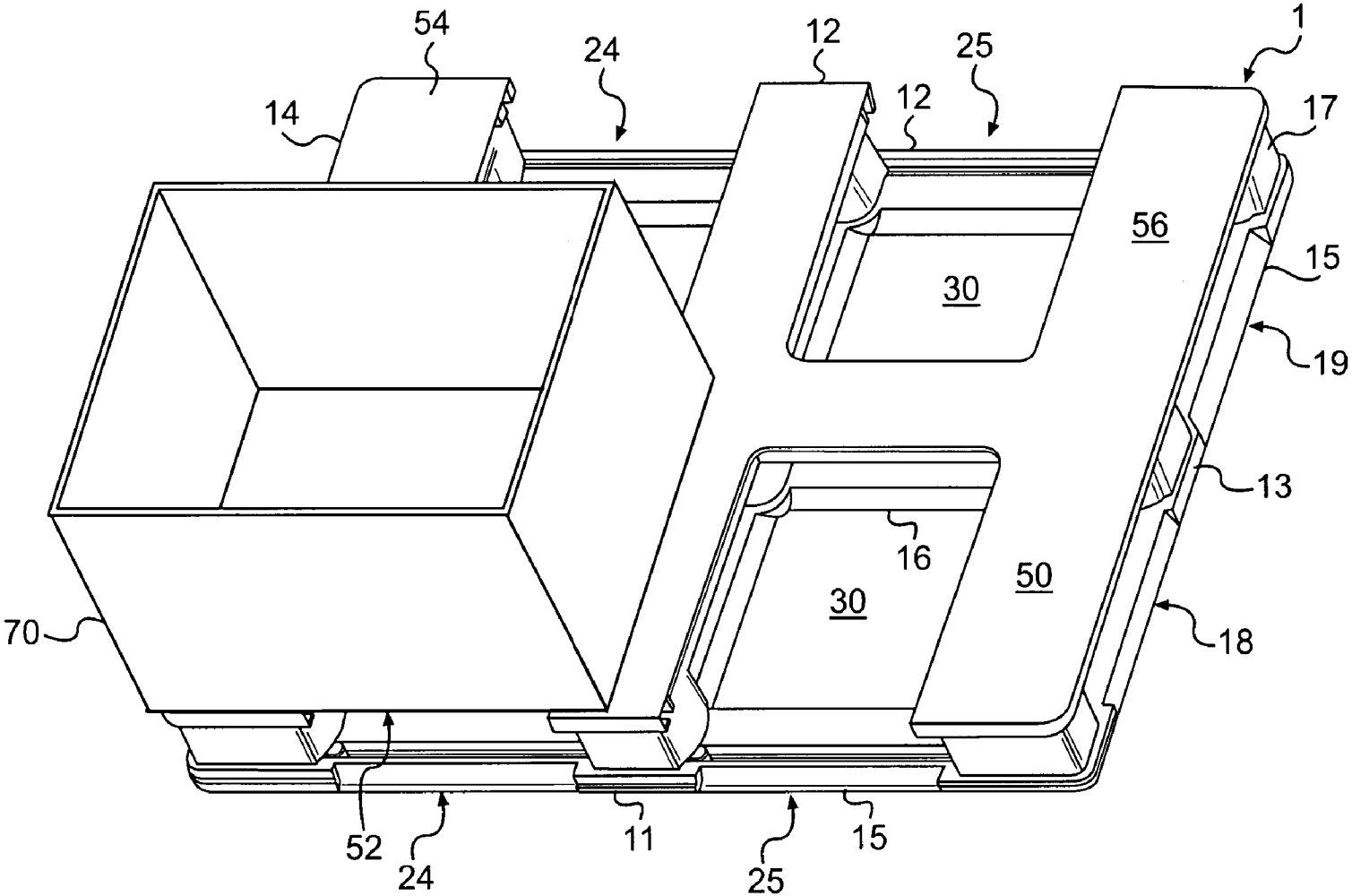
FIG. 5 is a perspective view of the pallet showing a representative load in one quadrant of the pallet according to the invention.
Figure 6:
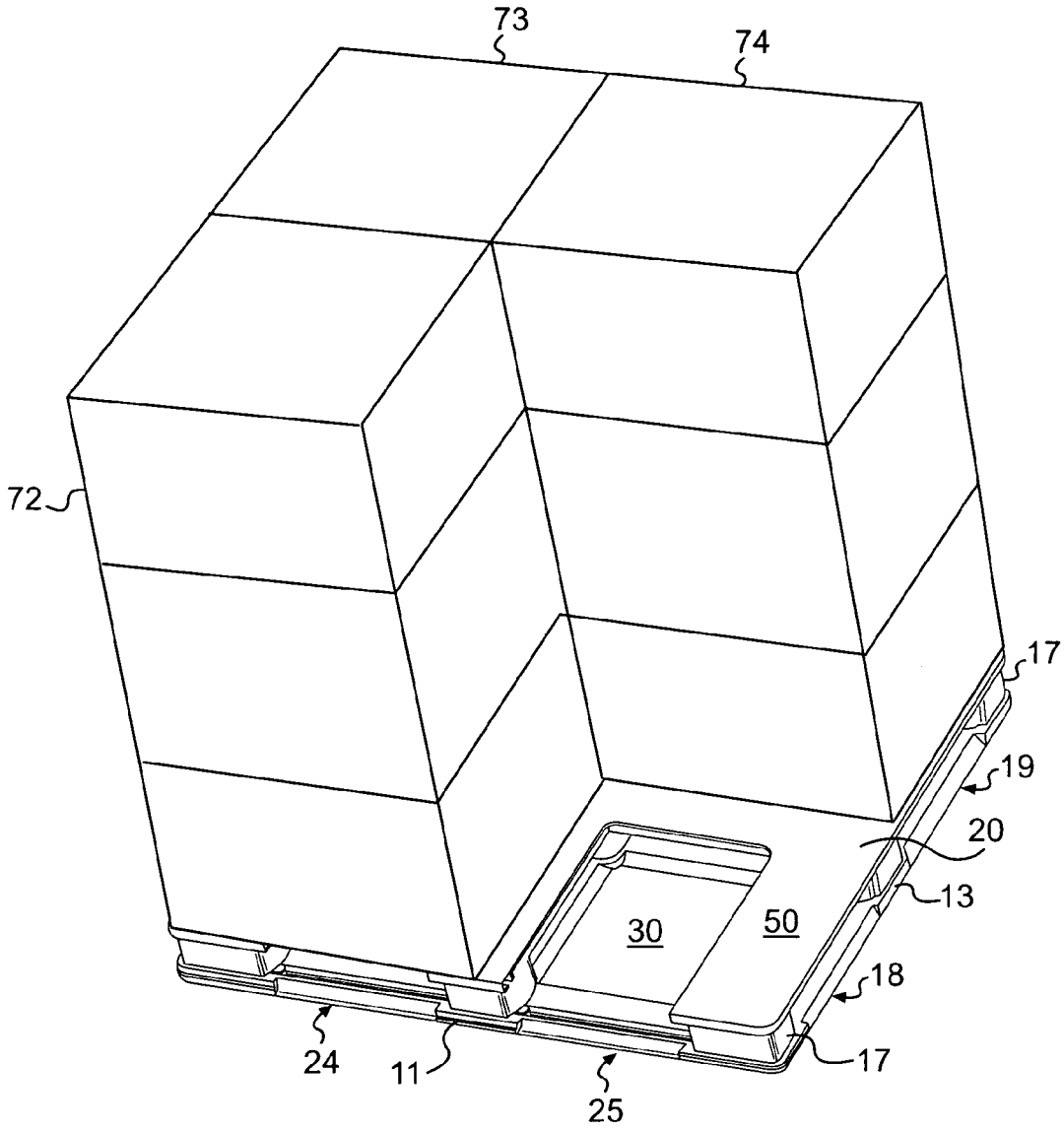
FIG. 6 is a perspective view of a representative load on the pallet shown in FIG. 1 with one quadrant of the pallet unloaded or removed with respect to the other quadrants.

Rather, the top deck 20 of the pallet has openings 30 that are separated by the mid-span 26 which extends from one end (12, 13) of the pallet to the other end and the cross-spans 27, 28 and 29 that extend from one side (11, 12) of the pallet to the other as shown in FIGS. 1 and 2. As shown in FIGS. 5 and 6, the pallet is preferably loaded in quadrants 50, 52, 54 and 56. Each quadrant has a product container or stack of product containers 70, one representative container being shown in FIG. 5. As shown in FIG. 6, the pallet can be loaded with stacks 72, 73 and 74 each separately stacked within a corresponding quadrant. FIG. 6 shows one of the quadrants removed from the pallet, which is enabled by the opening 30 in the top deck 20 of the pallet 10.

Figure 3:
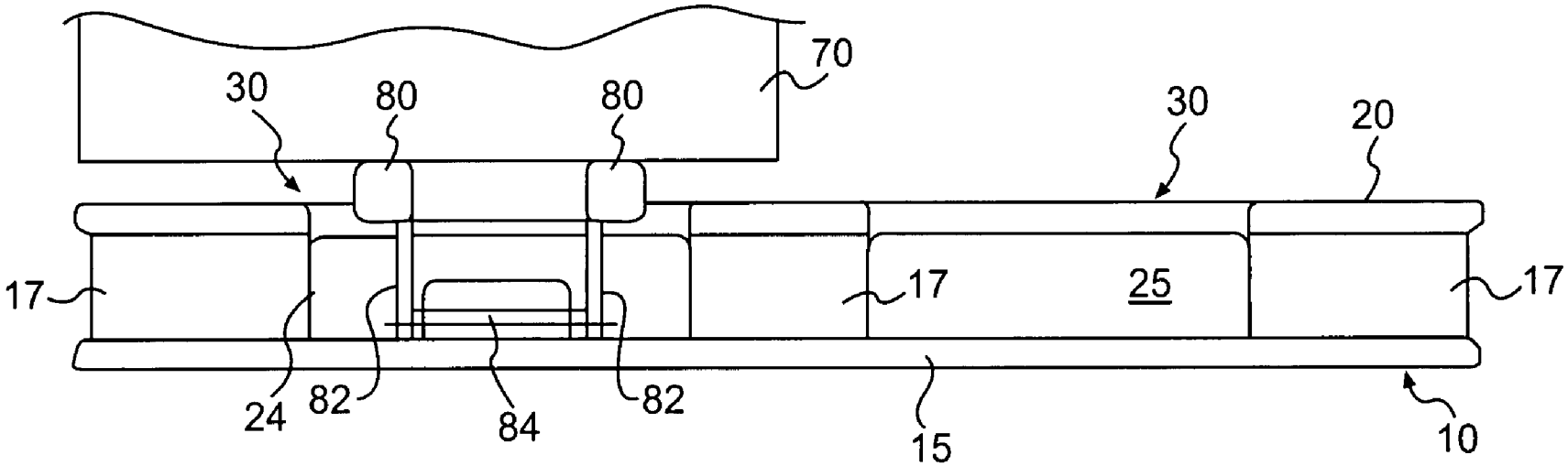
FIG. 3 is a front elevation of the pallet shown in FIG. 2.
Figure 4:
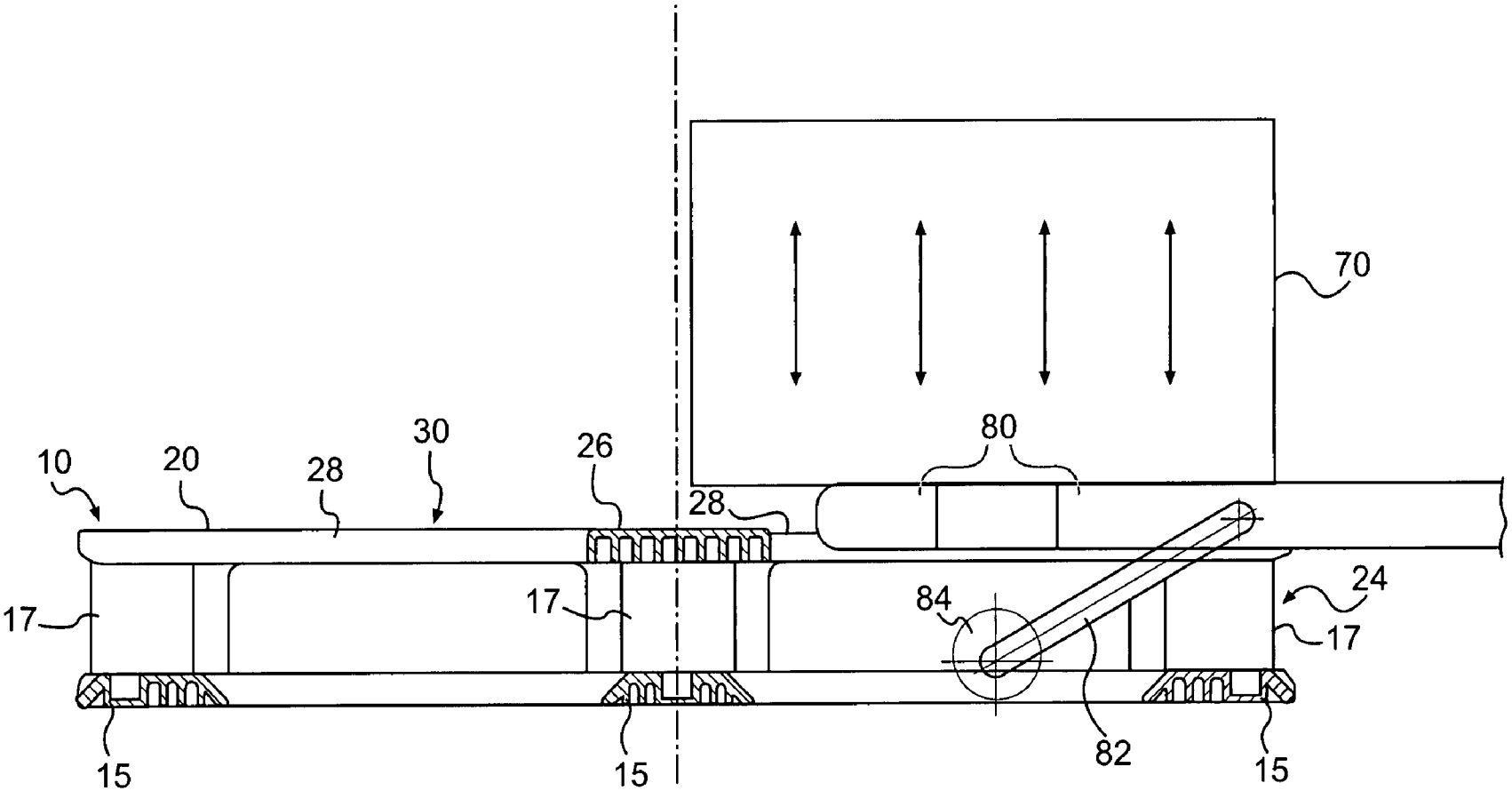
FIG. 4. is a cross sectional view along line 4-4 of FIG. 2.

In particular, with reference to FIGS. 3 and 4, the openings enable a single time of a fork lift or the tine(s) of a pump jack (single or double tine) to remove products from the individual pallet quadrants without picking up the entire pallet. FIG. 2 shows the blade 80 of a pump jack, or a blade of a forklift in relation to an opening 30 in top deck 20; and FIGS. 3 and 4 show the product container of one quadrant being lifted from the pallet without disturbing the product containers of the other quadrants by elevating the product (container) from its support on the top deck 20 of the pallet to a position above the top deck and withdrawing the product container(s) stack thereon. As further shown in FIG. 3, the blade 80 has a stabilizing arm 82 that engages a surface through a roller 84 as the blade is raised.

The pallet 20 of the present invention is useful in a distribution center in which products of one type are received from a manufacturer, however, mixed load pallets, i.e. pallets having products of different types are desired to be shipped from the distribution center to an end user, such as a retail outlet. By the present invention, articles or products of a pallet can be partially unloaded, one quadrant or two quadrants at a time, to enable a pallet initially containing products A to be unloaded and reloaded on a quadrant by quadrant basis with products B, C or D. Further, the products in each quadrant, when contained in a product container 70, are able to be mixed vertically so that products A, B, or C can be mixed in one vertical stack in one quadrant.

Although each opening 30 in the pallet top deck 20 is shown to enable the blade entry of a pump jack or utility truck, side-by-side quadrants of products can be removed at same time using a standard two bladed forklift whereupon one-half of the load of the pallet is removed at one time without disturbing the other half of the load of the pallet. Still further, FIGS. 1-3 show the openings 30 in pallet 20 to be suitable for the entry way of a pump jack, the opening is also suitable for access by a hand truck or other single or double bladed device that fits within the dimension of the opening 30 and that can be used to remove the product or product containers stacked within the quadrant of the opening.

Typical dimensions of the pallet of the present invention are those used in the industry, for example 40"×40" or 48"×42". Accordingly, the openings in top deck 20 of the pallet for a 48" wide pallet are preferably in the range of 12" to 18" in width and for a 40" or 42" deep pallet, the openings are 14 to 16" in depth, respectively. Of course, the openings can be made narrower or wider and also deeper or shallower so long as structural integrity of the top deck 20 is suitable for the intended load.

While preferred embodiments have been set forth with specific details, further embodiments, modifications and variations are contemplated according to the broader aspects of the present invention, all as determined by the spirit and scope of the following claims.

The invention claimed is:

1. A pallet comprising:

a top deck having a top load supporting surface;

a bottom deck;

opposing sides and ends;

posts extending between and connecting said top deck and said bottom deck whereby said top deck is spaced from said bottom deck;

a pair of spaced fork lift entry ways on each of said opposed sides or ends that extend underneath at least a portion of said top load supporting surface of said top deck;

said top deck comprising;

an opening formed in said top load supporting surface over each entry way on each of said opposed ends or sides, each said opening extending inwardly from a side or an end of said top deck;

a mid span forming part of said top load supporting surface and extending from either one side or end to an opposed side or end; and at least three cross spans forming part of said top load supporting surface and extending from the other of said one side or end to an opposed side or one end, said cross spans intersecting said mid span on said top load supporting surface at spaced intervals to form said openings and dividing said top load supporting surface into quadrants, with each quadrant having one of said openings;

whereby a bottom part of a portion of a load to be supported on one of said quadrants can be engaged through one of said entry ways and an opening there over to raise said portion of the load to be supported upwardly from said top load supporting surface separately from a remaining part of the load to be supported.

2. The pallet according to claim 1 which further comprises a pair of spaced fork lift entry ways on each of the other of the said opposed sides or ends.

* * * * *

UNITED STATES PATENT AND TRADEMARK OFFICE

CERTIFICATE OF CORRECTION

PATENT NO. : 7,543,539 B2
APPLICATION NO. : 11/395330
DATED : June 9, 2009
INVENTOR(S) : Daniel R. Miller It is certified that error appears in the above-identified patent and that said Letters Patent is hereby corrected as shown below:

ON THE TITLE PAGE

Please add (60) as follows:

Related U.S. Application Data

(60) Provisional application No. 60/667,098, filed on April 1, 2005.

Signed and Sealed this

Thirteenth Day of October, 2009

David J. Kappos

David J. Kappos
*Director of the United States Patent and Trademark Office*